United States Patent [19]

Knight, Jr.

[11] Patent Number: 5,035,002

[45] Date of Patent: Jul. 30, 1991

[54] KNOT COVER FOR TIES AND SCARFS

[76] Inventor: Charles F. Knight, Jr., 5610 N. Scottsdale Rd., Scottsdale, Ariz. 85253

[21] Appl. No.: 529,339

[22] Filed: May 29, 1990

[51] Int. Cl.[5] ..... A41D 25/08

[52] U.S. Cl. ..... 2/152 R; 2/148; 2/137; 2/149

[58] Field of Search ..... 2/152 R, 147, 153, 150, 2/148, 137, 144, 145, 149

[56] References Cited

U.S. PATENT DOCUMENTS

| | | | |
|---|---|---|---|
| 239,347 | 3/1881 | Selvage | 2/152 |
| 358,990 | 3/1887 | Schoening | 2/152 |
| 1,227,677 | 5/1917 | Schloerb | 2/148 |
| 2,170,707 | 8/1939 | Chapel | 2/153 |
| 2,180,861 | 11/1939 | Casidy | 2/153 |
| 2,316,002 | 4/1943 | Koivisto | 2/144 |
| 2,473,593 | 6/1949 | Lampbrechts | 2/153 |
| 2,553,437 | 5/1951 | Burke | 2/150 |
| 2,602,164 | 7/1952 | Venuti | 2/153 |
| 2,617,108 | 11/1952 | Anzell | 2/153 |
| 2,631,292 | 3/1953 | Cunningham | 2/153 |
| 2,728,081 | 12/1955 | Zele | 2/153 |
| 2,787,002 | 4/1957 | De La Piedra | 2/153 |
| 2,943,331 | 7/1960 | Toplansky | 2/150 |
| 3,060,448 | 10/1962 | Mongelli | 2/150 |
| 3,825,955 | 7/1974 | Penzel | 2/150 |
| 3,964,105 | 6/1976 | Gideon | 2/152 |
| 4,000,523 | 1/1977 | Woods | 2/150 |
| 4,206,513 | 6/1980 | Collins | 2/152 R |
| 4,489,443 | 12/1984 | Ellin | 2/153 |
| 4,542,537 | 9/1985 | Plapp et al. | 2/152 R |
| 4,573,219 | 3/1986 | Hooten | 2/152 |

*Primary Examiner*—Werner H. Schroeder
*Assistant Examiner*—Gloria Hale
*Attorney, Agent, or Firm*—Don J. Flickinger; Jordan M. Meschkow

[57] ABSTRACT

An accessory for simulating a knot on a necktie or scarf covering a looped section of the material. The knot simulator is held in place by a slot along the length of the cover channel to permit compression of the material, a flocked interior of the channel produces a frictional surface, and a resilient retainer enters the channel and resists one-way accidental removal. Decoration and further holding is included through a tie tack or earring aperture.

9 Claims, 1 Drawing Sheet

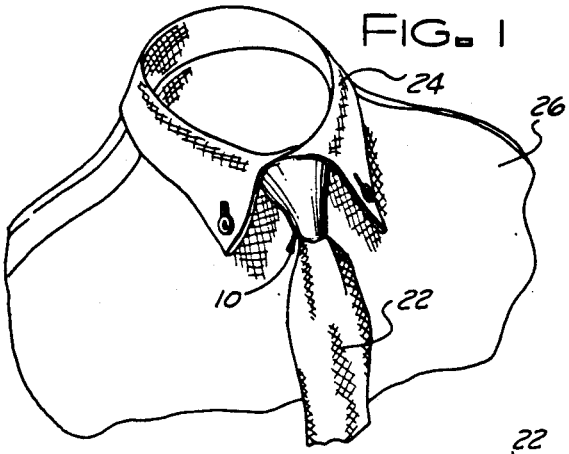
FIG. 1
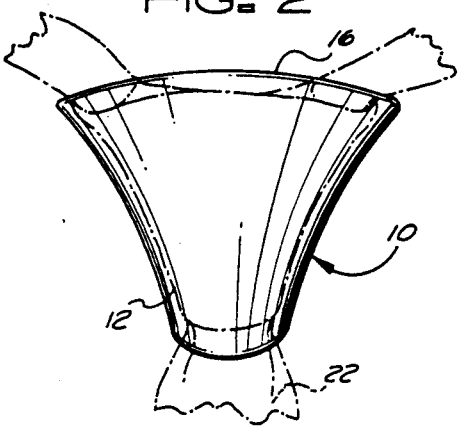
FIG. 2
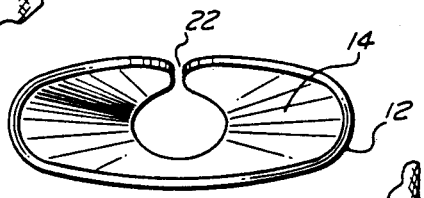
FIG. 3
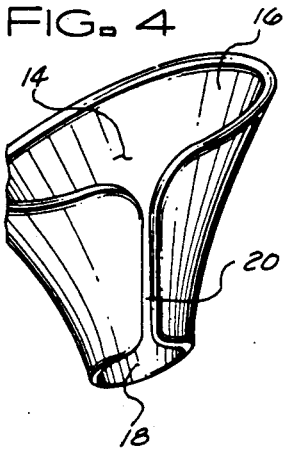
FIG. 4
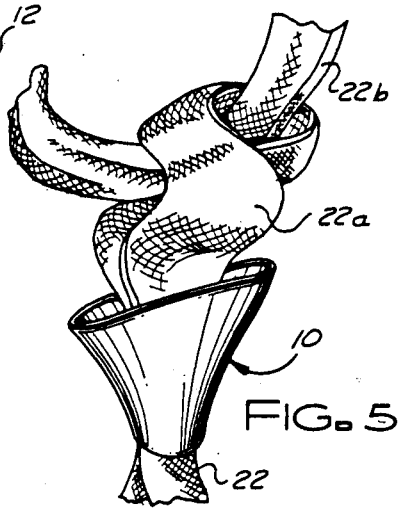
FIG. 5
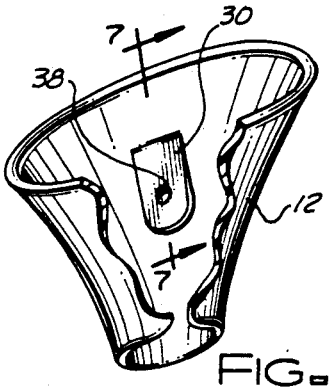
FIG. 6
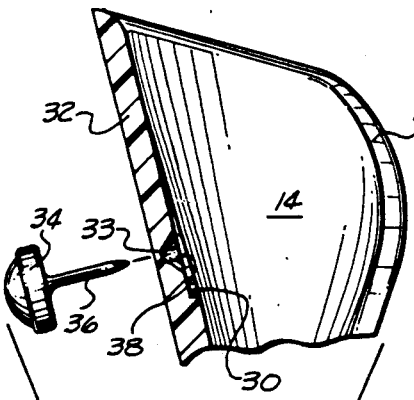
FIG. 7
FIG. 8
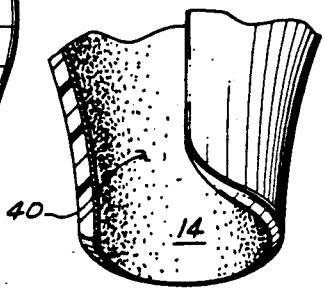
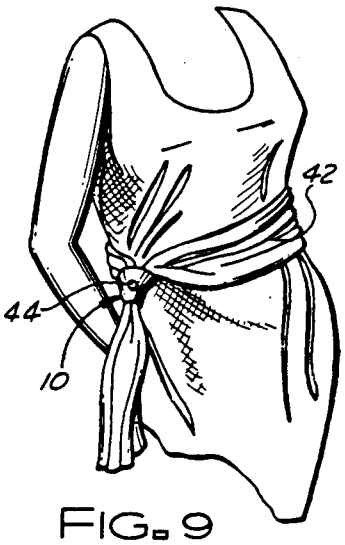
FIG. 9

KNOT COVER FOR TIES AND SCARFS

FIELD OF THE INVENTION

This invention relates generally to a knot cover for elongated lengths of material such as ties and scarfs. More particularly, the invention relates to a knot cover which enables a wearer to arrange a length of material in a normal position either as a tie or a scarf without tying a knot therein and wherein the knot cover is held into position without slippage.

BACKGROUND OF THE INVENTION

Tying a knot in an elongated length of material requires some skill especially in positioning the knot and is often bothersome and time consuming in that the knot has to be continually untied and retied to get the knot positioned correctly along the length of the material. Further, when the knot is tied many times, the material becomes worn and wrinkled at the knot position especially when the material is fabricated from certain materials such as silk.

Further, the correct positioning of the knot is often hard to determine because the lengths of the different ends must be different before tying the knot in order to anticipate what the lengths are going to be after the knot has been tied. The free ends of the material must be arranged rather precisely, especially if the material has a non-repetitive or intricate pattern, before tying the knot so that the knot will not interrupt the pattern in an unpleasing manner and be correctly located such that the lengths are appropriate.

Knot covers and simulators for neckties are well known in the art. Knot covers are primarily employed for purposes of appearance. The cover can hide soiled or wrinkled cloth or a poorly made knot. The user is still subjected to the laborious and time consuming task of first tying a knot. Simulators generally have open ends at the top through which the ends of the necktie are received to be pulled together at a common opening at the bottom to give the appearance of a knot. Advantageously, the need to tie a knot is eliminated. However, since a standard length tie includes material lessen to be used in the making of the knot, the knot simulator yields an unsightly tie of excessive length.

It is, therefore, an object of the present invention to provide a knot cover that permits the wearer to correctly position the elongated lengths of material into the separate lengths desired before attaching the knot cover.

Another object of the invention is the provision of a device which will eliminate the need to tie a knot yet will yield a tie of proper length.

The prior art has also provided various types of clip means to hold the elongated lengths of material. The clips operate to hold the panels of the neck tie to simulate a tied appearance. As with all clip apparatus for neck ties, the clips are often seen and detract from the appearance of the wearer in that the wearer is wearing a ready-made tie and not the standard four-in-hand necktie which is usually more pleasing to the viewer. The knot simulators that include the clips had the advantage over the other prior art in that it firmly held the elongated pieces of material and positioned the knot such that the knot did not slip.

It is, therefore, another object of the present invention to provide a knot simulator and cover which includes a retaining means to hold the knot simulator into place along the length of the material.

SUMMARY OF THE INVENTION

Accordingly, it is an object of the present invention to provide an enhanced means for covering and simulating a knot on an elongated length of material such as a neck tie or a scarf.

It is another object of the present invention to provide a knot cover which, when placed into position, firmly holds the material and will not slide out of position.

It is still another object of the present invention to provide an accurate means of positioning the knot such that the elongated lengths are looped and then the knot cover is placed into position against the loop to accurately position the knot along the desired length of the material as required by the wearer.

The above and other objects are achieved by the present invention which includes a knot cover for an elongated strip of fabric to simulate a knot in the fabric after the fabric is wrapped around a portion of the user. The knot cover according to the present invention includes a circular shape formed with an inverted truncated triangular configuration having an upper elongated opening and a lower more circular opening smaller than the upper elongated opening. The circular-shaped body encloses a single funnel-shaped channel from the upper opening through the lower opening. The upper opening is adapted to accept the free ends of the fabric and pass the free ends through the lower opening. The upper opening captures the loop section of the fabric to position and cover the looped section to simulate a knot. The body can include an indented section to receive the pointed post of a decoration such as a tie tack or a pierced-ear earring. The interior channel of the knot cover can be covered with flocking material, functioning as retaining means to increase the friction holding the knot cover in place on the fabric. Further, the knot cover can include a slot cut along the length of the channel such that the material of the tie a scarf can expand the channel and thereby the resilient material of the knot cover can assist in the capturing of the knot cover over the material.

These and other objects of the present invention will become apparent to those skilled in the art as the description proceeds.

BRIEF DESCRIPTION OF THE DRAWINGS

The various novel features of this invention along with the foregoing and other objects, as well as the invention itself both as to its organization and method of operation, may be more fully understood from the following description of illustrated embodiments when read in conjunction with the accompanying drawing wherein:

FIG. 1 is a perspective view of a knot cover shown on a neck tie and constructed in accordance with the principles of this invention;

FIG. 2 is a front elevation view of the knot cover of FIG. 1;

FIG. 3 is a top view of the knot cover of FIG. 2 further illustrating the internal construction details;

FIG. 4 is a perspective view of the rear section of the knot cover with a slot along the length of the cover according to a further embodiment;

FIG. 5 is a perspective view showing the knot cover according to FIG. 2 encompassing the looped section of a tie;

FIG. 6 is a cut away perspective view showing a retainer positioned in the knot cover according to FIG. 2 and showing a further embodiment of this invention;

FIG. 7 is a cut away side view of the knot cover of FIG. 6 taken along the line 7—7 showing the retainer in the knot cover and further showing the position of a decoration means which can be added to an embodiment of the present invention;

FIG. 8 is a cut away perspective view showing the interior of an embodiment according to the present invention; and FIG. 9 shows another usage of the knot cover according to the embodiments of the present invention for use to cover a body scarf loop on a wearer.

DESCRIPTION OF THE PREFERRED EMBODIMENTS

Referring now to the figures, similar reference numbers are used throughout the figures in order to assist the reader in identifying the invention. A knot cover 10 includes a circular shaped body 12 formed into an inverted truncated triangular configuration. The body encloses a single funnel shaped channel 14 having an elongated upper opening 16 and a smaller more circular opening 18 at the bottom of the funnel shaped channel 14. A slot 20 ca be formed along the length of the body 12 along the channel or the funnel 14 from the upper opening 16 to the lower opening 18.

Referring to FIG. 1, the knot cover 10 is shown positioned over an elongated piece of material shown as tie 22 and held in position against a collar 24 of a shirt 26. FIG. 1 shows the use of the knot cover 10 for use to simulate a knot in the tie 22 in lieu of the conventional knot of a tie. FIG. 5 shows the method by which the knot cover 10 is positioned over the elongated length of material such as the tie 22 of FIG. 1.

Referring to FIG. 5, the front or forward section **22*a* of the tie 22, which forms the longer length of the tie, is looped over the shorter or rearward portion 22*b* of the tie. The short or rearward portion 22*b* of the tie 22 and the forward portion 22*a* are both passed into the knot cover 10. The knot cover 10 is then placed to encompass the loop and both lengths 22*a* and 22*b* of the tie 22. After the knot cover 10 and the lengths of the tie 22 are pulled tight, the knot cover 10 is then correctly positioned against the collar 24 of the shirt 26 as shown in FIG. 1. Forming the loop as shown in FIG. 5 permits the correct positioning of the knot cover over the tie 22. The loop permits the approximate positioning of the knot cover 10 along the length of the tie 22. FIGS. 2, 3 and 4 show embodiments of the neck tie cover 10 positioned to hold the tie 22 according to FIGS. 1 and 5**.

Referring to FIGS. 2, 3 and 4, the knot cover 10 includes the body 12 formed to create the funnel 14. The funnel 14 has the upper elongated opening 16 and the circular smaller opening 18 at the bottom of the body 12. The free ends of the elongated piece of material such as the tie 22 of FIG. 5 are passed into the upper elongated opening 16 along the channel 14 and exit out the lower opening 18. The upper opening 16 and the channel 14 encompass the loop formed by the lengths **22*a* and 22*b* of the tie 22. As shown in FIGS. 3 and 4, the slot 20 can be formed along the length of the channel 14 such that the body 12 can provide a compressive force against the tie 22. The body 12 of the knot cover 10 is preferably made from a plastic material. As such, if the slot 20 is provided, the channel 14 can be made smaller than necessary such that when the loops 22*a* and 22*b* of the tie 22 are passed into the channel 14, the slot 20 allows the body 12 to expand to frictionally encompass the free ends of the tie 22**.

FIGS. 6 and 7 show an alternate embodiment of the invention which body 12 further includes depression 30 formed in the front section 32 along the interior of channel 14. Indentation 38 projects into front section 32 from depression 30. Preferrably conical in shape, indentation 38 terminates with an apex separated from the exterior surface of front section 32 by a relatively thin section of material 33. Depression 30 and indentation 38 facilitate the optional attachment of an ornament, especially one containing a gem stone such a conventional tie tac or post type earring. For purposes of illustration there is seen a conventional tie tac 34 including post 36 which, with minimal manual pressure, can pierce thin section 33 to extend through indentation 33. Although not specifically illustrated, but as will be appreciated by those skilled in the art, the tac can be retained by a clutch or other conventional means. In accordance with the preferred embodiment of the invention, ornamentation is affixed to cover 10 prior to being coupled with a neck tie. Alternately, post 36 may pierce the necktie and function as a retainer for securing the cover at a desired location.

FIG. 8 illustrates a preferred retaining means for positionally retaining cover 10 upon tie 22. As seen, interior channel 14 of body 12 can be provided with a surface 40 which produces a frictional surface with the tie 22 to assist in keeping the knot cover 10 in place. Preferably, surface 40 is in the form of a flocking coded to the interior funnel surface 14. Exemplary flocking are short fibers of acrylic, nylon or cotton. Other friction enhancing surfaces to assist in retaining the knot cover in place will readily occur to those skilled in the art.

FIG. 9 shows the adaptation of the knot cover 10 for use with a scarf 42 wrapped around the waist of a wearer. The knot cover 10 operates in the same manner as is shown in FIG. 5 for the tie 22. The ends of the scarf 42 are looped in the same manner and the knot cover is passed over the free ends of the scarf and tightened accordingly to hold the scarf 42 in place. Retaining means as previously described can be provided to assist in holding the knot cover 10 in position over the scaf 42. Further, a ladies earring 44 can be inserted into the knot cover 10 in the same manner as the tie tack 34 shown in FIG. 7. The ladies earring 44 includes a pointed appendage which operates in a similar manner to the tie tack 34.

The knot cover 10 of the present invention is a significant improvement over prior art knot simulators. The knot cover 10 can function as either a decorative protector of the elongated piece of material or as a tie fastener or a scarf connector in lieu of a conventional knot. The knot cover 10 is designed to hold the elongated piece of material in place after the material is looped through itself in an ordinary way or the knot cover 10 can be worn over a conventionally tied knot. Thus the position of the knot can be accurately placed. Further, other embodiments of the knot cover according to the present invention includes retaining means to hold the knot cover 10 in place. The interior fiber surface 40 can be added as a friction surface to keep the knot cover 10 in place as positioned through frictional contact between the interior surface 40 and the material of the tie 22. The knot cover 10 can be used for both neckties 22 and for scarfs 42 while still providing good protection against accidental removal. A tie tack 34 or a ladies earring 44 can be used to retain the knot cover 10 in place while also providing a decorative attachment. The depression 33 on the inside surface of the front face 32 of the body 12 provides a guide to assist the wearer in locating the exact center of the knot cover 10 when mounting jewelry pins or other ornamentations such as the tie tack 34, while the pointed appendage 36 of such a device further assists in holding the knot cover 10 into position as desired.

The body 12 can be constructed of an injection molded plastic which can then be coated with the short fiber acrylic flocking to form the interior fiber surface 40. The plastic materials used together with the wall thickness of the body 12 and the physical contours of the body 12 together with the slot 20 can permit flexing of the unit to compress the material inserted into the knot cover. The depression 30 as well as the indentation 38 in the retainer can be formed in the body 12 in the injection molding process.

Other materials and/or methods of construction could include a resilient material such as rubber in place of plastic in the formation of the body 12. A flat sheet plastic or metallic material may be bent to the retired contours in place of injection molding the body 12. Further, instead of the flocked finish for the interior fiber surface 40, the channel 14 of the body 12 may be covered with other materials, the only requirement for the embodiment being to provide some type of a frictional contact with the tie 22 or the scarf 42.

To use the knot holder of the present invention such as is shown for the tie 22 of FIG. 1, the wearer positions a standard tie 22 around his neck beneath the shirt collar 24. The broad end 22*a* of the tie 22 is looped over the narrower end 22*b* to allow the broad end 22*a* to hang down over the narrow end 22*b*. The knot cover 10 is then positioned over the tie by slipping the ends of the tie through the funnel 14 and sliding the body 12 upward to enclose the loop. The narrow end 22*b* of the tie may then be pulled until the loop of the forward section 22*a* and the knot cover 10 are pressed against the throat of the user. Different retaining means such as the interior surface 40 can be provided to hold the knot cover 10 in place. If the wearer then wishes to add decoration to the knot cover 10, a tie tack 34 can be attached as previously described.

The principles of the present invention have now been made clear in an illustrated embodiment. They will be immediately obvious to those skilled in the art, many modifications of structure, arrangement, proportions, the elements, materials and components used in the practice of the invention. For instance, the preferred embodiment shows the knot cover 10 used on the tie 22 and the scarf 42. It should be evident that any elongated piece of material can be held in place with the knot cover 10 of the present invention. The knot cover 10 can be used to hold sash accessory for a hat or a head or body scarf for instance. Further, the knot cover 10 can be used to simulate a knot over the excess fabric of a T-shirt wherein the wearer bunches together the fabric on one side of the bottom of the T-shirt and slips the knot cover 10 over the excess material to retain the bunched material. The retaining means as shown in the different embodiments of the present invention will hold the knot cover in place over the material. The material forming the body 12 of the knot cover is for example described as plastic or metallic. But it is evident that other materials could be used in substitution thereof. The materials only need to be of the description as outlined in the discussion of the invention. The appended claims are, therefore, intended to cover and embrace any such modifications, within the limits only of the true spirit and scope of the invention.

What I claim is:

1. A knot cover for an elongated strip of fabric to simulate a knot in the fabric after the fabric is wrapped around a portion of the user to allow the free end of the fabric after looping over each other to extend downward in a flowing, retained relationship, said knot cover comprising a body having a circular shape and formed with an inverted truncated triangular configuration and having an upper elongated opening and a lower more circular opening smaller than said upper elongated opening, said inverted triangular configuration including a front portion having an indented section operable to receive a pointed appendage.

2. A knot cover as described in claim 1 wherein said body includes a slot formed from said upper elongated opening to said lower opening at the back section of the inverted triangular configuration.

3. A knot cover as described in claim 1 wherein the interior of said funnel shaped channel is covered with a friction producing material.

4. A knot cover as described in claim 1 wherein the interior of said funnel shaped channel is covered with a flocking material to increase the friction of the channel against the free ends of the fabric.

5. A knot cover for an elongated strip of fabric to simulate a knot in the fabric after the fabric is wrapped around a portion of the user to allow the free end of the fabric after looping over each other to extend downward in a flowing, retained relationship, said knot cover comprising a body having a circular shape and formed with an inverted truncated triangular configuration and having an upper elongated opening and a lower more circular opening smaller than said upper elongated opening, said body enclosing a single funnel shaped channel from said upper opening through said lower opening, said knot cover further including retaining means for positionably retaining said body upon said material, wherein said retaining means includes an indented section operable to receive a pointed appendage.

6. A knot cover for an elongated strip of fabric to simulate a knot in the fabric after the fabric is wrapped around a portion of the user to allow the free ends of the fabric after looping over each other to extend downward in a flowing, retained relationship, said knot cover comprising:

a) a body having a circular shape and formed with an inverted, truncated triangular configuration and having an upper elongated opening and a lower more circular opening smaller than said upper elongated opening;

b) said body enclosing a single funnel shaped channel from said upper opening through said lower opening;

said upper opening adapted to accept the free ends of the fabric, with the free ends passing through said funnel shaped channel to exit said lower opening, said lower opening clamping the free ends of the fabric to hold the free ends together;

said upper opening encapsulating the looped section of the fabric; and said body being shaped to permit the free ends of the fabric to slidably pass into said upper opening through said channel and said lower opening while providing a frictional holding force to simulate a knot against the looped section of the fabric; and b) a retaining means for positionably retaining said body upon said material, wherein said retaining means includes an indented section which can receive a pointed appendage.

7. A knot cover as described in claim 6 wherein the pointed appendage is a tie tack.

8. A knot cover as described in claim 6 wherein the interior of said funnel shaped channel is covered with a friction producing material.

9. A knot cover as described in claim 6 wherein the interior of said funnel shaped channel is covered with a flocking material to increase the friction of the channel against the free ends of the fabric.

* * * * *

UNITED STATES PATENT AND TRADEMARK OFFICE

CERTIFICATE OF CORRECTION

PATENT NO. : 5,035,002

DATED : 30 July 1991

INVENTOR(S) : Charles F. Knight, Jr.

It is certified that error appears in the above-identified patent and that said Letters Patent is hereby corrected as shown below:

Column 6:
In Claim 6, line 12, delete "b)".

Signed and Sealed this

Twenty-seventh Day of October, 1992

*Attest:*

DOUGLAS B. COMER

*Attesting Officer*

*Acting Commissioner of Patents and Trademarks*